US007000651B2

(12) United States Patent
Fink, Jr. et al.

(10) Patent No.: US 7,000,651 B2
(45) Date of Patent: Feb. 21, 2006

(54) ENTHALPY EXTRACTOR FOR HYDROCARBON VAPORS

(75) Inventors: Arthur C. Fink, Jr., Lonedell, MO (US); Grenville G. Sutcliffe, Villa Ridge, MO (US)

(73) Assignee: Husky Corporation, Pacific, MO (US)

( * ) Notice: Subject to any disclaimer, the term of this patent is extended or adjusted under 35 U.S.C. 154(b) by 106 days.

(21) Appl. No.: 10/618,001

(22) Filed: Jul. 11, 2003

(65) Prior Publication Data

US 2005/0145294 A1 Jul. 7, 2005

Related U.S. Application Data

(60) Provisional application No. 60/396,589, filed on Jul. 17, 2002.

(51) Int. Cl.
*B65B 1/04* (2006.01)

(52) U.S. Cl. ..... 141/82; 141/59

(58) Field of Classification Search ..... 141/59, 141/82, 83, 286, 301, 302
See application file for complete search history.

(56) References Cited

U.S. PATENT DOCUMENTS 3,815,327 A * 6/1974 Viland ..... 95/220
4,566,504 A 1/1986 Furrow et al.
4,687,033 A 8/1987 Furrow et al.
5,197,523 A 3/1993 Fink, Jr. et al.
5,285,744 A 2/1994 Grantham et al.
5,394,909 A 3/1995 Mitchell et al.
5,417,256 A * 5/1995 Hartsell et al. ..... 141/7
5,476,125 A 12/1995 Mitchell et al.
5,520,228 A 5/1996 Fink, Jr. et al.
5,878,792 A * 3/1999 Pettazzoni et al. ..... 141/59
6,302,164 B1 * 10/2001 Nitecki et al. ..... 141/45

* cited by examiner

*Primary Examiner*—Steven O. Douglas
(74) *Attorney, Agent, or Firm*—Paul M. Denk

(57) ABSTRACT

A fuel storage tank vapor cooler to effect pressure reduction, in a fuel dispensing system, including the application of a refrigeration unit, that operates under the effects of a control unit, sensitive to vapor pressures, and vapor flow, to initiate the operations of the refrigeration unit, and effecting, through a properly located heat exchanger, a reduction in the temperature of the stored vapors, and thereby reducing its incident pressure. Such heat exchangers may be located either within the vapor storage area of the underground storage tank, the heat exchanger may locate in cooperation with the vapor return line, to the underground storage tank, or it may be located within the vent line from the storage tank, to chill the vapors and thereby provide for a reduction in their pressure. Such heat exchangers may be used in combination, or individually, whatever is determined to obtain the results as desired from the system of this invention.

3 Claims, 1 Drawing Sheet

ENTHALPY EXTRACTOR FOR HYDROCARBON VAPORS

CROSS REFERENCE TO RELATED APPLICATION

This non-provisional patent application claims priority to the provisional patent application having Ser. No. 60/396,589, which was filed on Jul. 17, 2002.

BACKGROUND OF THE INVENTION

As well known in the art, particularly in the field of fuel dispensing, EPA, in addition to various state regulatory agencies, such as the California Air Resources Board, have placed stringent demands upon the oil companies, in addition to the supplier of equipment for use in dispensing fuel, to totally eliminate the escape of any vapors or fumes into the atmosphere. This pressure has been placed upon the oil companies, and which is imposed upon the supplier of equipment, such as the companies furnishing dispensers, the companies providing underground storage tanks, and even those companies that furnish fuel dispensing nozzles. All of the efforts are directed towards capturing the vapors, and returning them back to the underground storage tank. Of more recent origin, is the on board vapor recovery, where the vapors are collected in the fuel tank, passed through a carbon filter, which eventually condenses some of the vapors, and then those condensed fumes are delivered to the carburetor or fuel injectors, for burning.

Obviously, it is impossible to obtain one hundred percent efficiency in capturing all vapors, and preventing some of their emission into the atmosphere. Normally, in the past, CARB required that at least ninety-five percent of the vapors be captured. This realistically recognized that about five percent of the fumes were going to escape, regardless what stringent efforts were placed upon the equipment to capture such fumes, and prevent their escape to the ambient air.

Recognizing that an extremely high efficiency in vapor collection is a requirement that is here to stay, efforts are now being made to refine the vapor collection techniques, and as identified in this current invention, to further attempt to process the vapors, in order to provide for their better handling, more efficient storage, and to minimize vapor escape into the atmosphere, in an effort to add further efficiency to this concept to attain vapor reduction, with respect to their escape into the ambient atmosphere.

Examples of vapor collecting techniques, through the use of coaxial hoses, etc., pumps within the dispenser, that return the vapors back to the underground storage tank, are well known in the art. For example, U.S. Pat. No. 5,285,744, shows a coaxial hose assembly, where returning fuel vapors from the nozzle are directed to the pump, through a coaxial hose. U.S. Pat. No. 5,197,523, shows a dispensing nozzle improvement for extracting fuel from the vapor return line, for a fuel dispensing system, which in this particular instance, the vapors are pumped back to the underground storage tank. The vapor control valve of U.S. Pat. No. 5,394,909, shows a method for capturing vapors, and returning them via the nozzle back to underground storage. U.S. Pat. No. 5,476,125, discloses a vapor recovery gasoline dispensing nozzle, for collecting vapors, and returning the same to the source of the fuel, its underground storage fuel tank. U.S. Pat. No. 5,520,228, discloses another fuel extraction coupling means for a nozzle, in order to keep the vapor return line clear, so that the vapors may be returned and pumped back through the dispenser to the underground storage. U.S. Pat. No. 4,566,504, shows an insertion tube liquid evacuator system for vapor recovery hose. Finally, U.S. Pat. No. 4,687,033, shows a venturi liquid evacuator system for maintaining clear vapor path in vapor recovery hoses. All of these various embodiments, as previously patented, many of them to the Assignee of this current invention, show the history of structures and methods for collecting vapors, and attempting to return them to the underground storage tank, with some degree of efficiency.

Other means are provided for attempting to handle the vapors being returned to the underground storage tank, in order to prevent their escape. Such other means, on the other hand, for accomplishing this result as in use are generally very complicated, and costly to install and maintain. Such systems have a tendency to reduce the system pressure by removing vapors, and processing them to remove or destroy the harmful hydrocarbons. This is a costly procedure. Furthermore, its effectiveness, is not overly efficient, unless the system is designed and installed to attain perfection, and that can be quite costly to operate, and must be carefully supervised. For example, others have attempted to produce a type of vapor processor, that seek to remove or minimize the hydrocarbons from within the returning vapors, but none of these vapor processors include the use of any type of cooling or chilling of the vapors, to attain beneficial results. For example, at the large tank farms, where fuel arrives by pipeline, large refrigeration units have been used to condense the hydrocarbon vapors back into liquid, to prevent their escape into the atmosphere. But, refrigeration units used in this manner are designed for condensation purposes, and not for temperature reduction per se.

SUMMARY OF THE INVENTION

The principal object of this invention is to provide means for chilling the vapor's returning to the underground storage tank, at various locations, for the purpose of contracting the vapors, providing some condensing of them, and as a result, providing a measured reduction in the pressure of the vapors that allows for more of such vapors to be stored, and at a lesser pressure.

This invention contemplates the adding of improvements to the dispensing of fuel, of the type of system that incorporates an underground storage tank, wherein fuel is stored for dispensing by the service station, and the like. A dispenser is normally associated with the underground storage tank, mounted on an island, and provides the usual means for dispensing fuel to the automobile fuel tank, through the coaxial hose, and through a nozzle, for injecting into the automobile. This is standard technology in the art, as well known.

The subject matter of this invention is to provide a refrigeration unit, having the heat exchanger or coils associated therewith, and locating the heat exchanger at one or more different positions, for the purpose of reducing the temperature of the vapors in the underground storage tank. Such heat exchanger may be located in the upper vapor storage section of the tank, or it may be located in proximity or surrounding the vapor return line, at the vicinity of the dispenser, or just before the vapors are returned back into the underground storage tank, or such heat exchanger may be located within the vent pipe structure that functions as a vent for the underground storage tank, in the event that excessive pressure is encountered. This is basically the concept of the invention, to provide means for reduction in the temperature of the vapors in the system, and therefore, reducing the pressure that such vapors exert upon the underground storage tank, and further provide a reduction in the volumetric capacity required for storage of such vapors. It is also likely that the vapors may be circulated to the heat exchanger, by a fan, or convection, to provide for their chilling. Such a fan may be fluid driven, when integrated into the refrigeration system.

Observations have been made, and tests conducted, of Phase II vapor recovery systems, of the vapor pressure in the fuel storage tanks that are caused by such systems, and because of the excessive pressure of such stored vapors, can cause this escape of such vapors somewhere in the system into the atmosphere. It is now recognized by the inventors herein that by cooling such vapors, their pressure can be reduced to near zero, and thereby lessening the chance that any vapors may escape into the atmosphere.

State regulatory agencies, such as CARB, have decreed that the system pressure in fuel tanks must be kept below ¼ inch of water column pressure, in order to minimize the escape of vapors to the atmosphere. The system of this current invention is novel from the standpoint that it does not remove vapors or condense them back into liquid, as other prior art systems may perform, but rather, it takes advantage of the small amount of vapors being returned to the fuel storage tank, by the Phase II vapor recovery systems, as a result of the introduction of on board vapor recovery systems equipment that are currently being installed in automobiles, this day and age. The ORVR vehicles do not return any substantial vapors back into the system, or its storage tank, so the removal of fuel creates negative pressure when the station is fueling vehicles.

It has been found that the only time such a system may tend to have a positive pressure is when the station is closed, as at night, or when fuel delivery has been made to the fuel storage tank, causing a slight growth in the pressure of the vapors. Under these circumstances, it is only necessary to prevent the pressure from going positive, and this can be done by cooling of vapors, in the manner as to be described herein. A reduction in temperature of 1° will reduce the volume enough to lower the pressure by 1 inch of water column. This has been determined empirically by test and measurements. A refrigeration unit smaller even than the type as used in standard home refrigerators, is all that is required to achieve a minor reduction in the temperature of the vapors, to have the beneficial effect as described herein.

A refrigeration unit of the conventional compressor type, and which may only require a one-eighth horse power motor to operate the compressor and condensers of this system, may be used. Or, a solid state thermoelectric type which may be used to cool the vapors in a fuel storage tank can be employed, when the pressure in such a storage tank tends to go positive. The cooling of the vapors can be accomplished by direct contact between the cooling coils containing the refrigerant, or by chilling a fluid, such as kerosene, and passing it through the coils in the vapor space.

The removal of one BTU of heat will cool 333 gallons of vapor 1° Fahrenheit. To cool 10,000 gallons of vapor, at least 1°, would require the removal of approximately 30 BTUs. 30 BTUs per minute of heat removal is 1,800 BTUs per hour, equal to 0.15 tons of refrigeration. This very small type of refrigeration unit, as referred to herein, can easily keep the pressure from increasing as actual testing has shown, such that when a station is shut down, the pressure will not increase at more than the average of 1 inch of water column per hour, and would therefore only require a temperature reduction of 1° per hour, which is a miniscule amount, for any type of small unit, and even a small or standard form of refrigeration equipment can be employed. Locating the equipment in the manner as previously summarized can easily attain that type of temperature reduction, in order to have the effects as desired from this invention.

In addition, the refrigeration unit would only operate when the pressure starts to go positive, or when the reverse flow is detected at any of the vapor flow meters as provided in current fuel dispensers.

During normal operation of the service station, the fueling of the ORVR vehicles generally maintain the system at a negative pressure. Hence, operating the refrigeration systems, under those circumstances, will not be required. But, when the fueling system is at steady state, such as at nighttime, or when gas dispensing in minimized, this is when the refrigeration units may be required to be initiated, to reduce the temperature of the vapors slightly, in order to get that pressure reduction as desired.

Obviously, one skilled in the art can determine, after reviewing the subject matter of this disclosure, that there are numerous locations in the vapor system where the heat exchanger may be located, in order to remove heat from the vapors and to provide for their chilling, or the vapors may be piped to the heat exchanger, as previously reviewed, for the purpose for providing for their reduction in temperature, and hence, their pressure.

The advantages of this current system, over what has been done previously in the past, include lower initial costs, ease of instillation, lowering the operating costs, and simple maintenance, which can be serviced by any available trained maintenance personnel. Any maintenance personnel, having the slightest information relative to standard refrigeration equipment, and its maintenance, can take care of the servicing of the vapor cooler of this invention.

It is, therefore, the principal object of this invention to provide a refrigeration system for reducing the temperature of any vapors returned to underground storage during fuel dispensing, in order to lessen the pressure of those vapors in the tank, to prevent their escape, or to cause any leakage in the underground storage tank, due to a build up of excessive pressures.

These and other objects may become more apparent to those skilled in the art upon review of the invention as summarized herein, and upon undertaking a study of the description of its preferred embodiment, in light of the drawings.

BRIEF DESCRIPTION OF THE DRAWING

In referring to the drawing, FIG. 1 provides a schematic of the fuel storage tank vapor cooler of this invention, used to effect vapor condensing and pressure reduction particularly for those vapors returned to an underground storage tank.

DESCRIPTION OF THE PREFERRED EMBODIMENT

Figure 1:
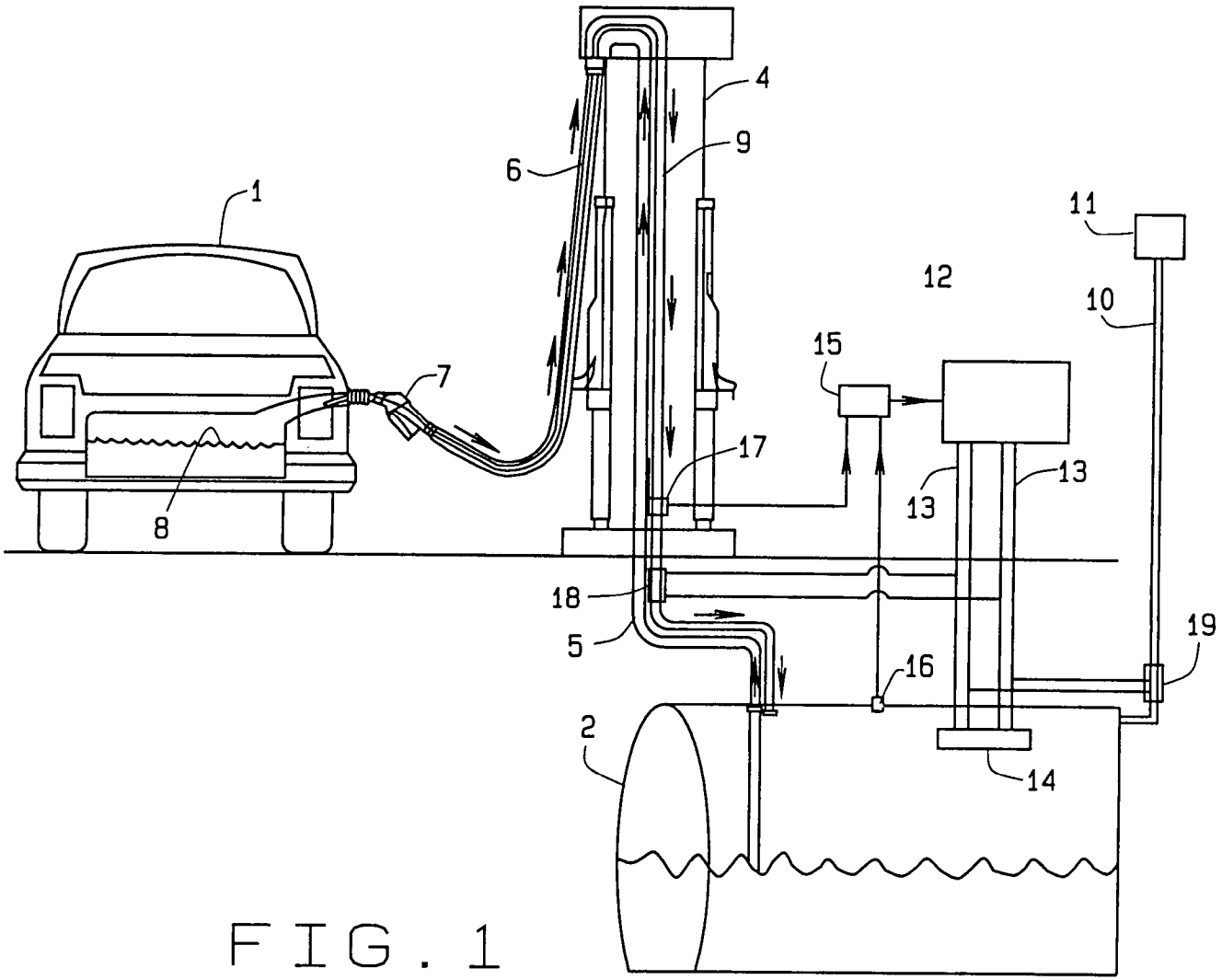

In referring to the drawing, and in particular FIG. 1, the standard method for dispensing of fuel to an automobile, as at 1, is through usage of an underground storage tank 2 at the service station, which contains a quantity of stored fuel 3, and a dispenser 4, which when initiated, pumps the fuel by way of the fuel line 5, through a coaxial hose 6, through the nozzle 7 and into the vehicle fuel tank 8, as can be noted. As is well known in the art, these coaxial hoses provide for the flow of fuel through one segment of the concentric hose, while the other portion of the hose returns vapors back into the underground storage tank, through the vapor line 9, as can be seen. In addition, a vent line 10 normally communicates with the upper vapor section of the underground storage tank, and disposes a vent 11, up in the air, in order to vent any vapors that may attain excessive pressure, to the atmosphere.

The subject matter of this current invention is the application of a refrigeration unit, as at 12. This refrigeration unit, or chiller as can be noted, is a typical refrigeration unit that may be operated by a small compressor, perhaps requiring nothing more than a one-eighth horse power, more or less, motor, to attain its functioning. The refrigeration unit cooperates by way of refrigerant flow lines 13, to a heat exchanger 14, and this heat exchanger is located within the upper vapor section of the underground storage tank, as can be noted. In this position, the heat exchanger provides for a reduction in the temperature of the vapors, which can achieve the type of pressure reductions, as previously referred to. A control unit, as at 15, is located to provide for the initiation and shut off of operations of the refrigeration unit, as required. For example, a pressure sensor 16 communicates with the upper vapor storage area of the underground storage tank, and can detect when the pressures reach a certain predetermined level, or when the pressure may convert from a negative to a positive pressure, particularly when ORVR type of dispensing of fuel is undertaken. A flow meter 17 is further connected to the control unit, to determine the quantity and capacity of the vapors being returned to the underground storage tank, which in combination with the pressure sensor, can provide for dictation to the control unit as to when the pressure buildup in the storage tank reaches that level that requires an initiation of the refrigeration unit, and operations of its heat exchanger, in order to reduce the temperatures of the returning and stored vapors, for purposes as previously described.

It is also just as likely, for reasons as previously reviewed, wherein a reduction of 1° may result in a lowering of the pressure by 1 inch of water column, that either supplemental, or other heat exchangers, may be located at various locations within the system, in order to effect such temperature reduction. For example, a heat exchanger 18 may be located as jacketed around the return vapor line, just as the vapors are entering into the storage tank. This will have a tendency to provide for a direct reduction in vapor temperatures, as the vapors are being returned, just prior to their delivery to the underground storage tank. Or, a heat exchanger 19 may locate in the vent line, in order to have an effect upon the vapors at that location, which, when operated, the refrigeration unit will have a tendency to lower the temperature of the vapors, pervading in the vicinity of the upper portion of the storage tank, to attain the desirable results as explained herein. These various heat exchangers 12, 18, and 19, may be used in combination, or any one of them may be used as the primary temperature reducer, in order to attain the beneficial results as desired and required from this invention. These are examples as to how the proper location of a heat exchanger, used in cooperation with a refrigeration unit, can be employed to have a direct effect upon the temperature of the vapors, and therefore, be directly proportional to a reduction in the vapor pressures, as can be understood.

Variations or modifications to the subject matter of this invention may occur to those skilled in the art upon review of the disclosure as provided herein. Such variations, if within the spirit of this development, are intended to be encompassed within the scope of the invention as described. The description of the preferred embodiment, and the depiction of the invention in the drawing, is set forth for illustrative purposes only.

What is claimed is:

1. An enthalpy extractor system for hydrocarbon vapors as stored within an underground storage tank that includes an upper vapor section and for use in conjunction with a fuel dispensing system including at least one dispenser, and nozzle, for dispensing of fuel, and including a vapor return line for returning vapors from the dispensing area back to an underground storage tank, said system including an underground storage tank, a vapor return line communicating with the underground storage tank to provide for return of vapors from the location of fuel dispensing, a vent pipe operatively associated with the underground storage tank to provide for venting of excessive vapors, a refrigeration unit operatively associated with the underground storage tank, said refrigeration unit includes a heat exchanger that is located within the upper vapor section of the underground storage tank, said refrigeration unit providing for the operations of said heat exchanger to condense hydrocarbon vapors stored within the vapor section of the underground storage tank, a control unit operatively associated with the refrigeration unit to provide for its initiation and shut-off of operations during performance of the system, a pressure sensor located within the vapor section of the underground storage tank to provide for the detection of pressure within the vapor storage area to determine the level of vapor pressure, and to provide a signal to the control unit to initiate operations of the refrigeration unit, such that any vapors returned and stored within the underground storage tank will be control chilled by said heat exchanger to condense the hydrocarbon vapors and thereby reduce the pressure of vapors that are stored within the underground storage tank.

2. The enthalpy extractor system of claim 1, and including an additional refrigeration unit system operatively associated with at least one of the vent pipe and vapor return line to effect a chilling and condensing of any vapors located therein, for return back to the vapor section of the underground storage tank.

3. The enthalpy extractor system of claim 1 and including a flow meter, operatively connected with the control unit, to determine the quantity and capacity of vapors being returned to the underground storage tank.

* * * * *